US012753536B2

(12) United States Patent
Lee et al.

(10) Patent No.: US 12,753,536 B2
(45) Date of Patent: Oct. 6, 2026

(54) CIRCULAR KNITTING MACHINE FOR KNITTING DOUBLE-SIDED YARN-DYED FABRIC

(71) Applicant: PAI LUNG MACHINERY MILL CO., LTD., New Taipei (TW)

(72) Inventors: Chih-Chiang Lee, New Taipei (TW); Tao Chiang, New Taipei (TW)

(73) Assignee: PAI LUNG MACHINERY MILL CO., LTD, New Taipei City (TW)

( * ) Notice: Subject to any disclaimer, the term of this patent is extended or adjusted under 35 U.S.C. 154(b) by 0 days.

(21) Appl. No.: 19/289,948

(22) Filed: Aug. 4, 2025

(65) Prior Publication Data

US 2026/0103829 A1 Apr. 16, 2026

(30) Foreign Application Priority Data

Oct. 14, 2024 (TW) ..... 113138913

(51) Int. Cl.
*D04B 9/28* (2006.01)
*D04B 15/32* (2006.01)

(52) U.S. Cl.
CPC ..... *D04B 9/28* (2013.01); *D04B 15/322* (2013.01)

(58) Field of Classification Search
CPC ... D04B 9/28; D04B 9/34; D04B 9/38; D04B 15/32; D04B 15/322; D04B 15/34
See application file for complete search history.

(56) References Cited

FOREIGN PATENT DOCUMENTS

| | | | | | |
|---|---|---|---|---|---|
| CN | 110129974 | B | * | 7/2023 | ..... D04B 15/32 |
| CN | 118621486 | A | * | 9/2024 | ..... D04B 1/102 |
| EP | 3978673 | A1 | * | 4/2022 | ..... D05C 11/24 |
| EP | 4286577 | A1 | * | 12/2023 | ..... D04B 9/34 |
| EP | 4332286 | A1 | * | 3/2024 | ..... D04B 1/02 |
| EP | 4530382 | A1 | * | 4/2025 | ..... D04B 35/04 |
| JP | 6562890 | B2 | | 8/2019 | |
| JP | 7445050 | B1 | * | 3/2024 | |
| JP | 7478299 | B1 | * | 5/2024 | |
| KR | 20250045828 | A | * | 4/2025 | ..... D04B 15/52 |
| TW | I608140 | B | | 12/2017 | |
| TW | I724452 | B | | 4/2021 | |
| TW | I831107 | B | | 2/2024 | |
| TW | I836922 | B | | 3/2024 | |
| TW | I852480 | B | | 8/2024 | |

* cited by examiner

*Primary Examiner* — Danny Worrell
(74) *Attorney, Agent, or Firm* — MUNCY, GEISSLER, OLDS & LOWE, P.C.

(57) ABSTRACT

A circular knitting machine for knitting a double-sided yarn-dyed fabric includes a cylinder, a dial, at least one yarn feeder and at least one needle selector. The cylinder includes first knitting needles configured to form front loops of the fabric. The dial includes second knitting needles configured to form back loops of the fabric. The yarn feeder feeds a first colored yarn and a second colored yarn. Each first knitting needle has a first track and a second track partially overlapped with the first track. The first knitting needle draws only the first colored yarn to form the front loop along the first track, and draws only the second colored yarn to form the front loop along the second track. Each second knitting needle only has a single track to draw both the first colored yarn and the second colored yarn to form the back loop.

5 Claims, 5 Drawing Sheets

CIRCULAR KNITTING MACHINE FOR KNITTING DOUBLE-SIDED YARN-DYED FABRIC

FIELD OF THE INVENTION

The invention provides a circular knitting machine, more particularly to a circular knitting machine for knitting a double-sided yarn-dyed fabric.

BACKGROUND OF THE INVENTION

Patents such as TWI852480B, TWI836922B, TWI831107B, TWI724452B, TWI608140B, and JP656890B2 have disclosed techniques for knitting yarn-dyed fabrics using circular knitting machines. However, it can be understood from the aforementioned patents that each of front loops in conventional yarn-dyed fabrics is knitted by a face yarn and a ground yarn jointly. The purpose of color variation is achieved by altering the relative positions of the face yarn and the ground yarn, thereby changing the form of each of the front loops. Although the existing method can achieve the purpose of color variation, the face yarn and the ground yarn are only changed in relative positions, even when the face yarn is intended to be a color-developing, the ground yarn can still be seen to some extent within each of the front loops upon looking straight at the front loops. As a result, a color of each of the front yarn loops appears impure. When viewing the yarn-dyed fabric as a whole, patterns formed by the front yarn loops appear blurred.

SUMMARY OF THE INVENTION

A main object of the invention is to solve the problem of impure color development of the front loops in conventional yarn-dyed fabrics, which tends to occur when a non-color-developing yarn is knitted together with a color-developing yarn.

In order to achieve the above-mentioned object, the invention provides a circular knitting machine for knitting a double-sided yarn-dyed fabric. The circular knitting machine includes a cylinder, a dial, a cylinder cam set, a dial cam set, at least one yarn feeder and at least one needle selector. The cylinder includes a plurality of first knitting needles guided by the cylinder cam set, while the dial includes a plurality of second knitting needles guided by the dial cam set. The first knitting needles knit is configured to form a plurality of front loops of a double-sided yarn-dyed fabric, and the second knitting needles knit is configured to form a plurality of back loops of the double-sided yarn-dyed fabric. The at least one yarn feeder feeds a first colored yarn and a second colored yarn. Each of the first knitting needles is provided with a first track and a second track that partially overlaps with the first track. Each of the first knitting needles only draws the first color yarn to form one of the front loops along the first track. Each of the first knitting needles only draws the second colored yarn to form one of the front loops along the second track. Each of the second knitting needles is configured to be guided by the dial cam set to only have a single track, and each of the second knitting needles is configured to draw the first colored yarn and the second colored yarn to form one of the back loops. The at least one needle selector is configured to control the first knitting needles to move along the first track or the second track.

In one embodiment, each of the first knitting needles is provided with a third track that does not extend outward to draw the first colored yarn or the second colored yarn, and the at least one needle selector controls the first knitting needles to move along one of the following: the first track, the second track, or the third track.

In one example, the first track includes a first rising section, a first descending section following the first rising section, a holding section following the first descending section, and a loop-forming section following the holding section, and the second track includes the first rising section, the first descending section, a second rising section following the first descending section, a second descending following the second rising section, and the loop-forming section following the second descending section. When each of the second knitting needles descends to form a loop, one of the first knitting needles disposed adjacent thereto and configured to cooperate in a knitting process, is guided to move in the loop-forming section of either the first track or the second track.

In one example, the at least one yarn feeder is provided with a first yarn feeding hole through which the first colored yarn passes and a second yarn feeding hole through which the second colored yarn passes, and a first imaginary plane where the first yarn feeding hole is located intersects with a second imaginary plane where the second yarn feeding hole is located.

Through the above technical implementation of the invention, compared with the conventional techniques, the invention has the following characteristics: each of the first knitting needles of the invention is provided with the first track and the second track, each of the first knitting needles is configured to only draw the first colored yarn to form one of the front loops in the first track, each of the first knitting needles is configured to only draw the second colored yarn to form one of the front loops in the second track, each of the second knitting needles is configured to be guided by the dial cam set and has only a single track, each of the second knitting needles is configured to draw the first colored yarn and the second colored yarn to form one of the back loops.

The front side of the double-sided yarn-dyed fabric knitted by the circular knitting machine of the invention is formed by the front loops, each composed of a single colored yarn. As color is exhibited by the single colored yarn, a resulting color appears purer compared to that of conventional yarn-dyed fabrics, which achieve color variation through changing the relative positions of a face yarn and a ground yarn in plated loop configurations. Consequently, the front loops on the front side of the double-sided yarn-dyed fabric of the invention appears improved color purity, enhancing a clarity of individual color block on the front side of the double-sided yarn-dyed fabric.

DETAILED DESCRIPTION OF THE PREFERRED EMBODIMENTS

The detailed description and technical content of the invention are described below with reference to the accompanying drawings.

Figure 1:
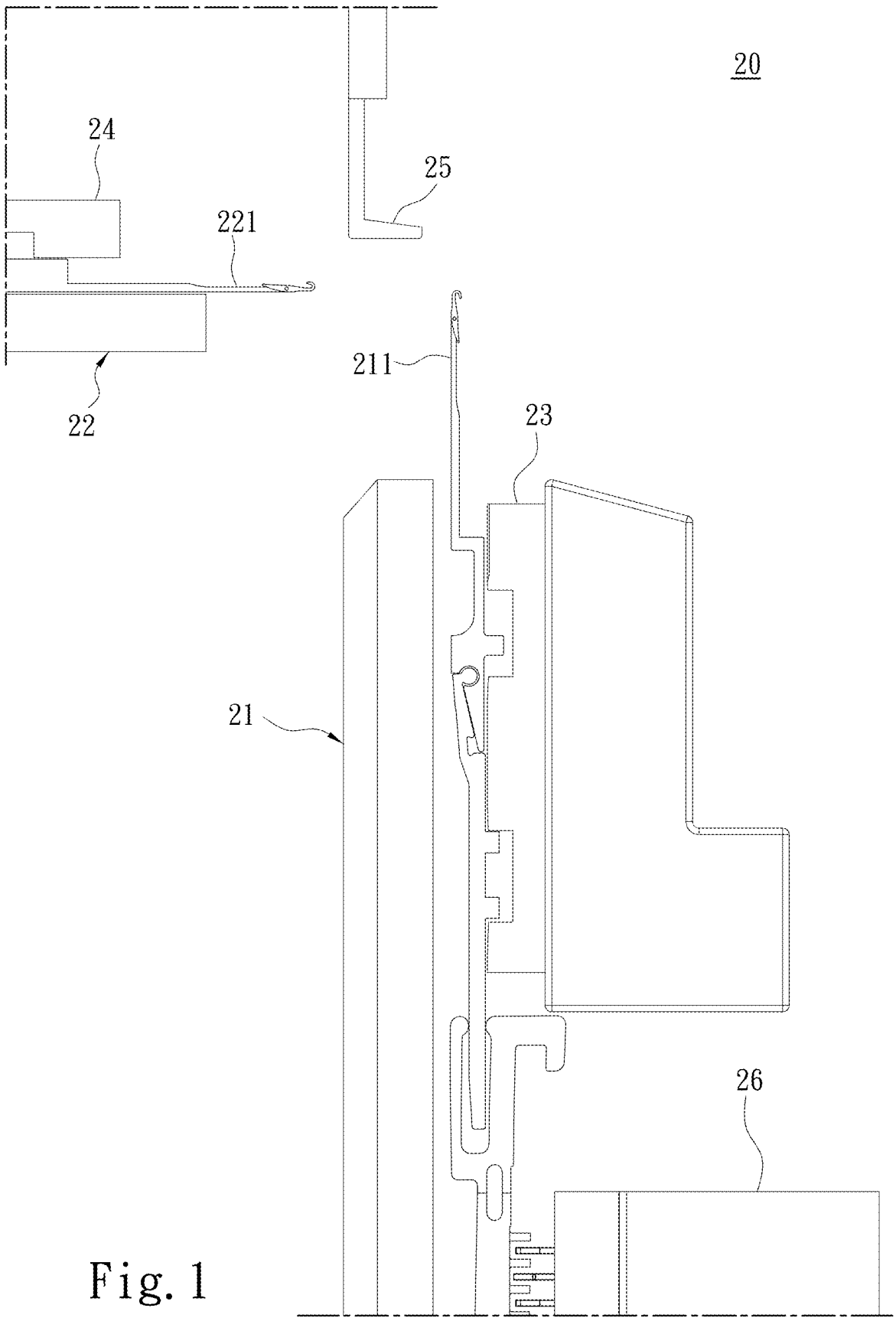
FIG. 1 is a schematic diagram of a structure of an embodiment of a circular knitting machine of the invention.

Please refer to FIG. 1. The invention provides a circular knitting machine 20, which includes a cylinder 21 (also referred to as a lower needle bed), a dial 22 (also referred to as an upper needle bed), a cylinder cam set 23, a dial cam set 24, at least one yarn feeder 25 and at least one needle selector 26.

The cylinder 21 includes a plurality of first knitting needles 211. The first knitting needles 211 are guided by the cylinder cam set 23 to perform yarn-looping actions and are each capable of reciprocating motion along only a single axial direction. The dial 22 includes a plurality of second knitting needles 221. The second knitting needles 221 are guided by the dial cam set 24 to perform yarn-looping action and are each capable of reciprocating motion along only a single axial direction. The single axial direction of each of the second knitting needles 221 is perpendicular to that of one of the first knitting needles 211. The at least one needle selector 26 is configured to determine the movement tracks of the first knitting needles 211 within the cylinder cam set 23.

Figure 2:
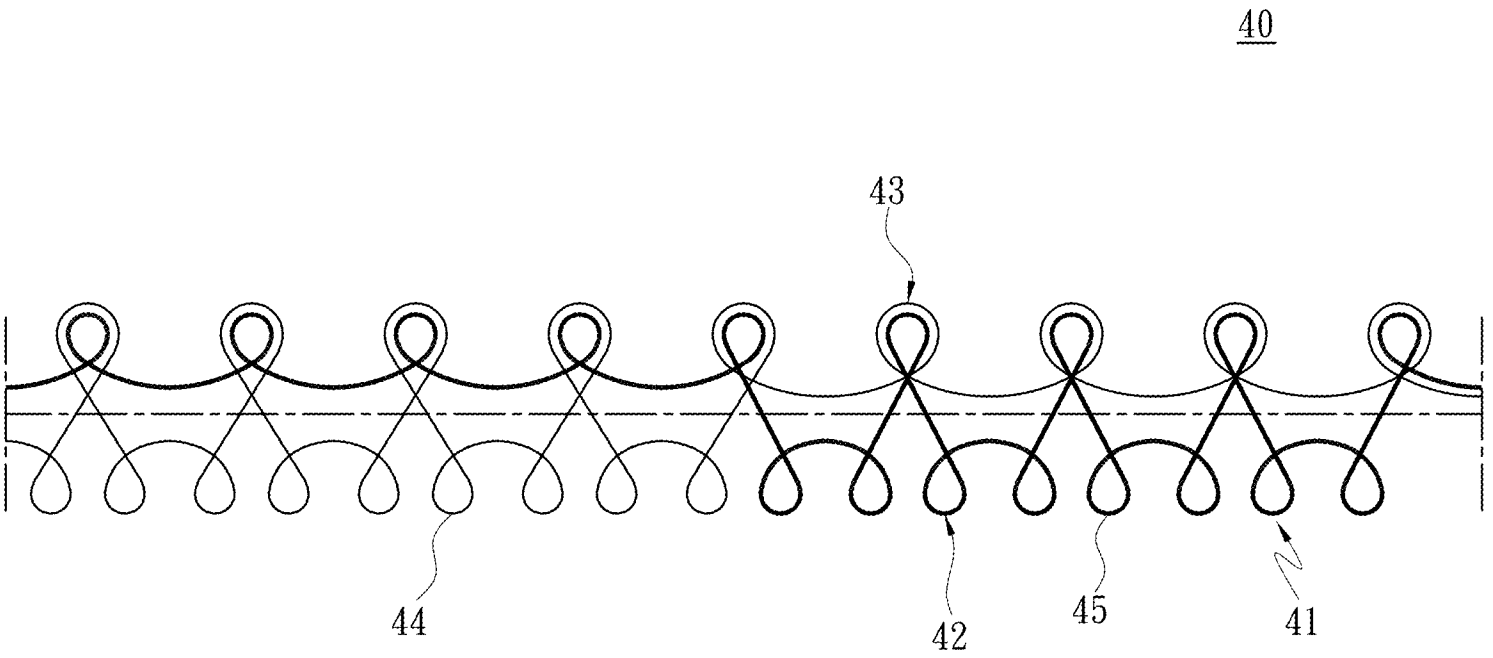
FIG. 2 is a schematic diagram of a structure of an embodiment of a double-sided yarn-dyed fabric of the invention.

Please refer to FIG. 2. The circular knitting machine 20 of the invention is used to knit a double-sided yarn-dyed fabric 40. A front side 41 of the double-sided yarn-dyed fabric 40 can exhibit color variation through yarn loops. The double-sided yarn-dyed fabric 40 includes a plurality of front loops 42 and a plurality of back loops 43.

In the invention, the first knitting needles 211 of the cylinder 21 are configured to form the front loops 42 of the double-sided yarn-dyed fabric 40, and the second knitting needles 221 of the dial 22 are configured to form the back loops 43 of the double-sided yarn-dyed fabric 40. The at least one yarn feeder 25 is configured to feed a first colored yarn 44 and a second colored yarn 45, which may be of different colors.

It should be understood that, when the at least one yarn feeder 25 of the invention is configured in plural, each of yarn feeders 25 feeds two colored yarns (for example, the first colored yarn 44 and the second colored yarn 45). Colors of the yarns fed by the yarn feeders 25 are not limited to being the same. In one example, one of each pair of adjacent yarn feeders 25 may feed two colored yarns of different colors, while the other may feed another two colored yarns that are different from the aforementioned two colored yarns. As a result, the front side 41 of the double-sided yarn-dyed fabric 40 can exhibit four-color variation.

Figure 3:
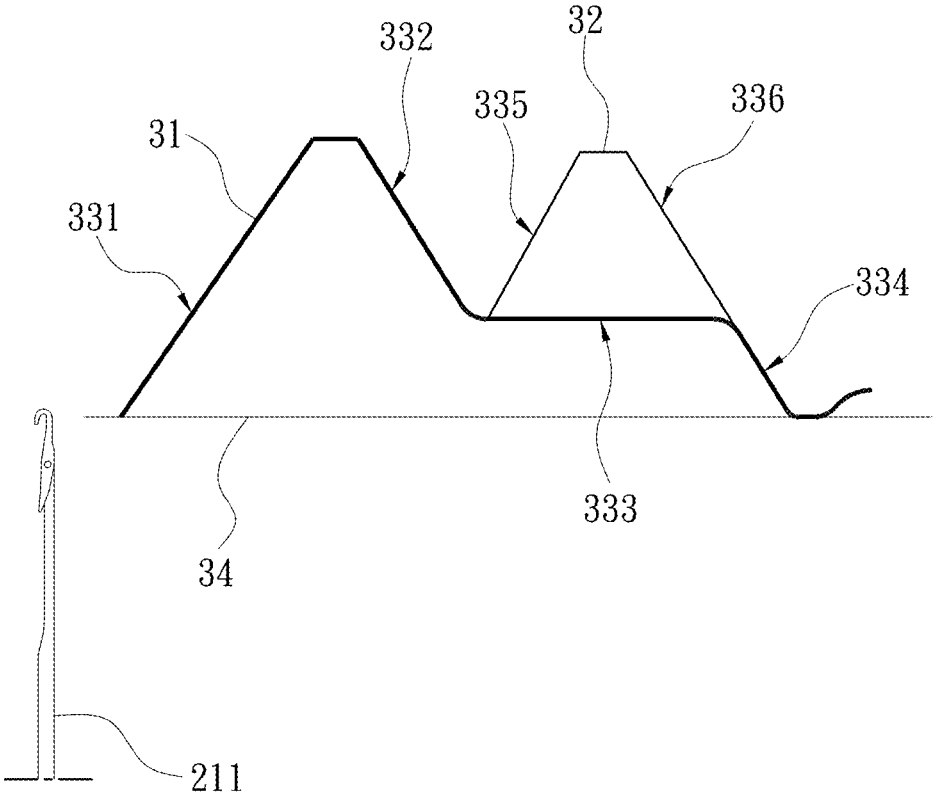
FIG. 3 is a schematic diagram of each track of a first knitting needle of the invention.
Figure 4:
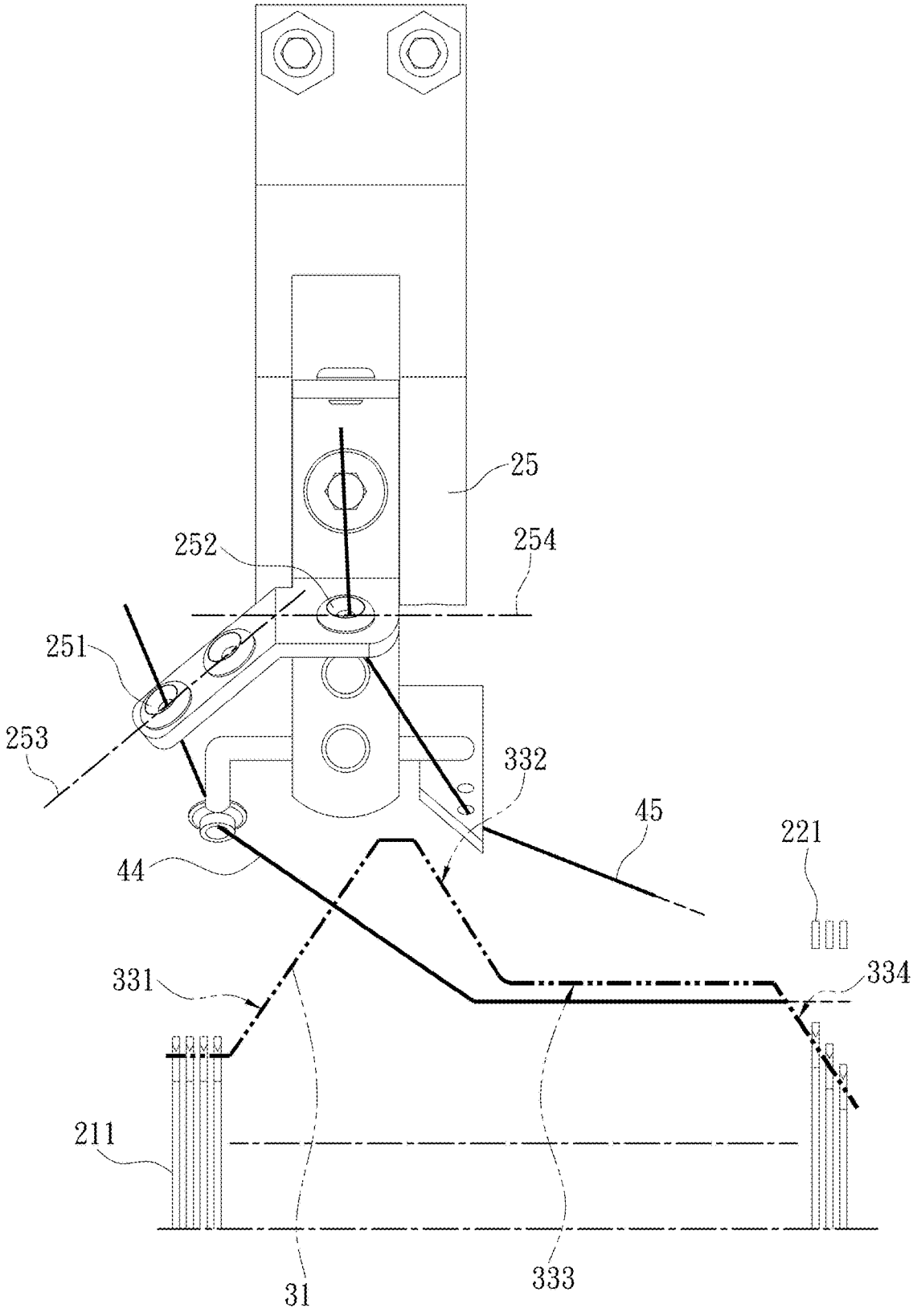
FIG. 4 is a schematic diagram of implementation of the first knitting needle of the invention moving in a first track.
Figure 5:
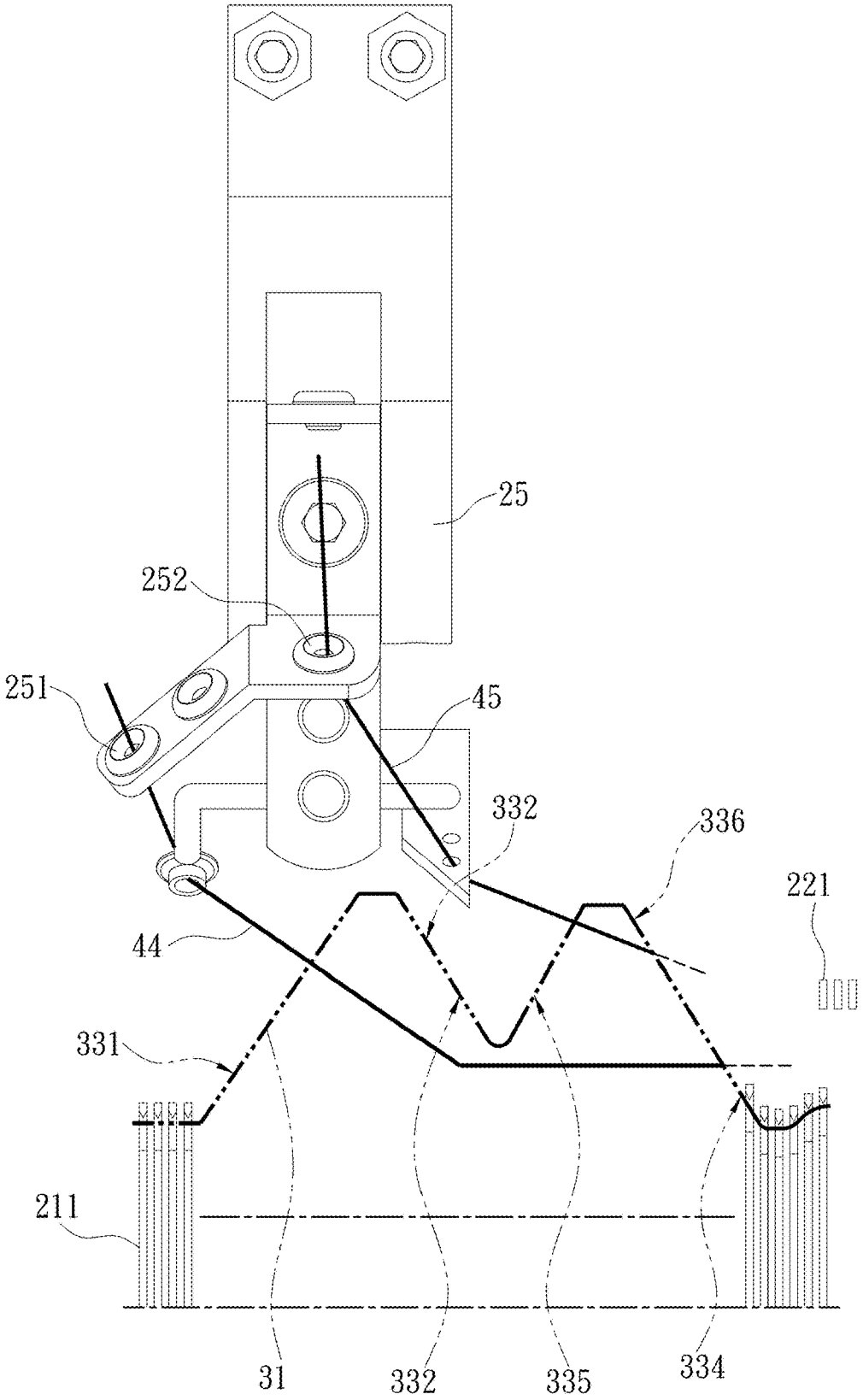
FIG. 5 is a schematic diagram of implementation of the first knitting needle of the invention moving in a second track.

Please refer to FIG. 3, FIG. 4 and FIG. 5. The cylinder cam set 23 of the invention enables the first knitting needles 211 to provide with a plurality of movement tracks. Each of the first knitting needles 211 of the invention is provided with a first track 31 and a second track 32, and the second track 32 partially overlaps with the first track 31. Both the first track 31 and the second track 32 include yarn-looping actions. Along the first track 31, each of the first knitting needles 211 is configured to only draw the first colored yarn 44 to form one of the front loops 42, and each of the first knitting needles 211 is configured to only draw the second colored yarn 45 to form one of the front loops 42. The second knitting needles 221 are guided by the dial cam set 24 and have a single track. Each of the second knitting needles 221 is configured to draw both the first colored yarn 44 and the second colored yarn 45 upon movement, forming loops with the first colored yarn 44 and the second colored yarn 45 simultaneously.

As describe above, each of the front loops 42 in the double-sided yarn-dyed fabric 40 contains a single colored yarn (either the first colored yarn 44 or the second colored yarn 45), while each of the back loops 43 contains two colored yarns (i.e., the first colored yarn 44 and the second colored yarn 45) fed by the same yarn feeder 25. Furthermore, on the front side 41 of the double-sided yarn-dyed fabric 40 knitted by the circular knitting machine 20 of the invention, each of the front loops 42 is formed from only one colored yarn (either the first colored yarn 44 or the second colored yarn 45). As color is exhibited by a single yarn, a resulting color appears purer compared to that of conventional yarn-dyed fabrics, which achieve color variation through changing the relative positions of face yarns and ground yarns in plated loop configurations. Consequently, the front loops 42 on the front side 41 of the double-sided yarn-dyed fabric 40 of the invention appears improved color purity, enhancing a clarity of individual color blocks on the front side 41 of the double-sided yarn-dyed fabric 40.

Please refer to FIG. 3, FIG. 4 and FIG. 5 for further explanation of the first track 31 and the second track 32. In one example, the first track 31 includes a first rising section 331, a first descending section 332 following the first rising section 331, a holding section 333 following the first descending section 332, and a loop-forming section 334 following the holding section 333. More specifically, when one of the first knitting needles 211 moves along the first track 31, one of the first knitting needles 211 draws the first colored yarn 44 while moving into the first descending section 332 and then enters the holding section 333. The first colored yarn 44 remains being drawn by one of the first knitting needles 211 until that needle moves to the loop-forming section 334 of the first track 31.

On the other hand, before explaining the second track 32, it is necessary to first understand that although the second colored yarn 45 and the first colored yarn 44 are supplied by the same yarn feeder 25, a slope of the second colored yarn 45 differs that of the first colored yarn 44, resulting in different yarn-drawing positions.

Continuing to explain the second track 32. In this example, the second track 32 includes the first rising section 331, the first descending section 332 following the first rising section 331, a second rising section 335 following the first descending section 332, a second descending section 336 following the second rising section 335, and the loop-forming section 334 following the second descending section 336. The second track 32 overlaps with the first track 31 at the first rising section 331 and the first descending section 332. When one of the first knitting needles 211 moves along the second track 32, one of the first knitting needles 211 is configured to draw the first colored yarn 44 at the first descending section 332. However, as one of the first knitting needles 211 continues into the second rising section 335, the engagement with the first colored yarn 44 is released. Upon entering the second descending section 336, one of the first knitting needles 211 draws the second colored yarn 45 and proceeds to knit with the second colored yarn 45 in the loop-forming section 334. Accordingly, when each of the second knitting needles 221 descends to form a loop, one of the first knitting needles 211, which is disposed adjacent thereto and configured to cooperate in the knitting process, is guided to move in the loop-forming section 334 of either the first track 31 or the second track 32.

Please refer to FIG. 3. In one example, each of the first knitting needles 211 is provided with a third track 34. When each of the first knitting needles 211 moves along the third track 34, each of the first knitting needles 211 does not extend outward to draw either the first colored yarn 44 or the second colored yarn 45. In this example, the at least one needle selector 26 controls the first knitting needles 211 to move along one of the following: the first track 31, the second track 32, or the third track 34. The third track 34 is disposed for an object of: when the front side 41 of the double-sided yarn-dyed fabric 40 is implemented with four colors, each of the yarn feeders 25 only supplies two of the four colors. Therefore, when yarns supplied by one of the yarn feeders 25 are not required for current knitting, at least one of the first knitting needles 211 currently corresponding to one of the yarn feeders 25 does not perform a loop-forming action (i.e., does not extend outward and instead moves along the third track 34).

Please refer to FIG. 4. The at least one yarn feeder 25 includes a first yarn feeding hole 251 and a second yarn feeding hole 252. The first yarn feeding hole 251 is passed through by the first colored yarn 44, and the second yarn feeding hole 252 is passed through by the second colored yarn 45. A first imaginary plane 253 where the first yarn feeding hole 251 is located intersects with a second imaginary plane 254 where the second yarn feeding hole 252 is located. Due to different positions of the first yarn feeding hole 251 and the second yarn feeding hole 252, paths of the first colored yarn 44 and the second colored yarn 45 do not overlap with each other.

What is claimed is:

1. A circular knitting machine for knitting a double-sided yarn-dyed fabric, comprising a cylinder, a dial, a cylinder cam set, a dial cam set, and at least one yarn feeder, the cylinder comprising a plurality of first knitting needles guided by the cylinder cam set, the dial comprising a plurality of second knitting needles guided by the dial cam set, the plurality of first knitting needles being configured to form a plurality of front loops of the double-sided yarn-dyed fabric, the second knitting needles being configured to form a plurality of back loops of the double-sided yarn-dyed fabric, the at least one yarn feeder being configured to feed a first colored yarn and a second colored yarn, the circular knitting machine characterized in that:

each of the first knitting needles is provided with a first track and a second track partially overlapped with the first track, each of the first knitting needles is configured to only draw the first colored yarn to form one of the front loops along the first track, each of the first knitting needles is configured to only draw the second colored yarn to form one of the front loops along the second track, each of the second knitting needles is configured to be guided by the dial cam set to only have a single track, each of the second knitting needles is configured to draw the first colored yarn and the second colored yarn to form one of the back loops, and the circular knitting machine comprises at least one needle selector configured to control the first knitting needles to move along the first track or the second track.

2. The circular knitting machine for knitting the double-sided yarn-dyed fabric as claimed in claim 1, wherein each of the first knitting needles is provided with a third track that does not extend outward to draw the first colored yarn or the second colored yarn, and the at least one needle selector controls the first knitting needles to move along one of the following: the first track, the second track, or the third track.

3. The circular knitting machine for knitting the double-sided yarn-dyed fabric as claimed in claim 2, wherein the first track comprises a first rising section, a first descending section following the first rising section, a holding section following the first descending section, and a loop-forming section following the holding section, the second track comprises the first rising section, the first descending section, a second rising section following the first descending section, a second descending section following the second rising section, and the loop-forming section following the second descending section, and when each of the second knitting needles descends to form a loop, one of the first knitting needles disposed adjacent thereto and configured to cooperate in a knitting process, is guided to move in the loop-forming section of either the first track or the second track.

4. The circular knitting machine for knitting the double-sided yarn-dyed fabric as claimed in claim 1, wherein the first track comprises a first rising section, a first descending section following the first rising section, a holding section following the first descending section, and a loop-forming section following the holding section; the second track comprises the first rising section, the first descending section, a second rising section following the first descending section, a second descending section following the second rising section, and the loop-forming section following the second descending section; and when each of the second knitting needles descends to form a loop, one of the first knitting needles disposed adjacent thereto and configured to cooperate in a knitting process, is guided to move in the loop-forming section of either the first track or the second track.

5. The circular knitting machine for knitting the double-sided yarn-dyed fabric as claimed in claim 4, wherein the at least one yarn feeder is provided with a first yarn feeding hole through which the first colored yarn passes and a second yarn feeding hole through which the second colored yarn passes, a first imaginary plane where the first yarn feeding hole is located intersects with a second imaginary plane where the second yarn feeding hole is located.

* * * * *